United States Patent [19]

Moshnin et al.

[11] 4,106,322

[45] Aug. 15, 1978

[54] PRESS FOR PRESSING PIPE FITTINGS

[76] Inventors: Evgeny Nikolaevich Moshnin, ulitsa Akademika Pavlova, 50, kv. 5; Alexei Fedorovich Nistratov, ulitsa Khlobystova, 16, korpus 1, kv. 48; Viktor Alexeevich Odnodushny, Stremyanny pereulok, 2/12, kv. 8; Nikolai Ivanovich Romashko, Sumskoi proezd, 12, korpus 4, kv. 108; Nikolai Pavlovich Schlyakhin, Stremyanny pereulok, 17/12, kv. 43, all of Moscow, U.S.S.R.

[21] Appl. No.: 725,506

[22] Filed: Sep. 22, 1976

[51] Int. Cl.[2] ..... B21D 22/00

[52] U.S. Cl. ..... 72/356; 29/157 A; 72/358; 72/403; 72/478

[58] Field of Search ..... 72/353, 356, 358, 399, 72/400, 403, 478, 453.09, 453.01; 29/157 A, 157 R

[56] References Cited

U.S. PATENT DOCUMENTS

| | | | |
|---|---|---|---|
| 2,534,185 | 12/1950 | Taylor | 29/157 A |
| 2,675,049 | 4/1954 | Martin | 29/157 A X |
| 3,302,445 | 2/1967 | Müller et al. | 72/435 X |
| 3,323,347 | 6/1967 | Dean | 72/453.09 |
| 3,869,776 | 3/1975 | Nikolaevich et al. | 29/157 A |

*Primary Examiner*—Leon Gilden
*Attorney, Agent, or Firm*—Fleit & Jacobson

[57] ABSTRACT

A press with crossheads interconnected by vertical pillars, at least one of said crossheads moving relative to the stationary crosshead which carries a sliding table with the lower die, the upper die being secured to the movable crosshead above. The stationary crosshead accommodates a rod and the drive of a pulling device connected with an auxiliary crosshead below, said auxiliary crosshead having vertical spindles with stops which interact with the adjacent movable crosshead at the beginning of radial compression of the tubular billet.

7 Claims, 7 Drawing Figures

PRESS FOR PRESSING PIPE FITTINGS

The present invention relates to equipment for pressing pipe fittings, e.g., Tee-pipes, pipe branches, reducers and can be utilized in power engineering, petrochemical and other branches of machine-building industry.

The Author's Certificate No. 212968 issued in USSR covers an installation for pressing pipe unions and connections from tubular billets. This installation comprises a press with two stationary crossheads and one movable crosshead arranged one above another and interconnected by vertical pillars. The lower stationary crosshead carries a sliding table with the lower die accommodating the tubular billet. The upper die is secured on the movable crosshead which is mounted above said stationary crosshead and provided with a reciprocating drive. The upper stationary crosshead carries a pulling device consisting of a rod with a reciprocating drive. This rod passes through a vertical passage extending along the axis of the press in the movable crosshead and in the upper die secured on it. The lower die located on the sliding table which is mounted on the stationary crosshead receives a tubular billet whose side wall has a hole for inserting the free end of the rod of the pulling device and for connecting said end with the punch entering into the space of the tubular billet.

The known installation is adapted for pressing Tee-pipes, cross pipes, pipe unions and connections by drawing and flanging the wall of a tubular billet.

However, the branch pipes of the articles produced on this installation are insufficiently high which affects adversely their future employment.

The arrangement of the pulling device on the upper stationary crosshead calls for the introduction of devices for aligning the hole in the side wall of the tubular billet with the rod of the pulling device. Such devices result in considerable complication of the die design.

Besides, the presses of this type require a very accurate alignment of the die parts.

In the course of operation the table with the lower die is extended from the press, the billet is placed on the die and the table is pushed back home. This motion may cause longitudinal displacement of the tubular billet and, consequently, of the hole in its wall relative to the rod of the pulling device.

Owing to this displacement the rod of the pulling device may miss the hole and strike against the wall of the tubular billet, distorting the latter.

Considerable difficulties in operating the press are also caused by the fact that the tubular billet to be pressed is heated to 1050° - 1100° C; its alignment involves considerable losses of time which cuts down press output and affects adversely the quality of the products.

An object of the present invention resides in eliminating the aforesaid disadvantages.

The main object of the invention is to provide a press for pressing pipe fittings which would improve the quality of the pressed products.

Another no less important object of the invention is to simplify the design of the press dies.

An important object of the invention resides also in raising the press output.

And still another object of the invention is to improve the conditions of press operation.

These and other objects are achieved by providing a press for pressing pipe fittings which comprises crossheads arranged one above another, interconnected by pillars and provided with a drive for reciprocating at least one of said crossheads, a sliding table mounted on the stationary crosshead and carrying the lower die, the upper die being secured on the movable crosshead above, a pulling device consisting of a rod provided with a reciprocating drive and located in a vertical passage extending along the press axis in one of the crossheads and in the die secured to it, and a punch for insertion into the tubular billet placed on the lower die and provided with a hole in the side walls for inserting the end of said rod and connecting it with the punch wherein, according to the invention, the rod and the drive of the pulling device are installed in the stationary crosshead carrying the sliding table with the lower die and are connected with an auxiliary crosshead below, said crosshead carrying vertical spindles provided with stops which interact with the adjacent movable crosshead at the beginning of radial compression of the tubular billet.

The arrangement of the pulling device on the stationary crosshead carrying the lower die simplifies the alignment of the hole in the side wall of the tubular billet with the rod of the pulling device. This makes it possible to dispense with the aligning devices because it is enough to place the tubular billet with the hole pointing down and set this hole in line with the rod.

This ensures accurate alignment of the tubular billet with the rod of the pulling device so that the beginning of drawing a branch from the billet coincides with the beginning of radial compression of said billet.

It is particularly important that such an arrangement makes it possible to increase the height of the branches of the tubular billet thereby improving the quality of the products.

Besides, simplification of the aligning operation improves the conditions of press operation and this saving of time steps up the press output.

It is practicable that the vertical spindles should be located on the auxiliary crosshead at the side of the rod of the pulling device and that the stationary crosshead carrying the sliding table with the lower die should be provided with vertical passages to accommodate said spindles so that their stops at the beginning of radial compression of the tubular billet would interact with the movable crosshead carrying the upper die.

The arrangement of the spindles in the die space of the press facilitates the resetting of the pulling device when changing over to pressing of tubular billets of different dimensions.

It is good practice if one of the press crossheads is located below the auxiliary crosshead, is connected with a drive and provided with vertical passages for the spindles located on the underside of the auxiliary crosshead so that their stops would interact with said movable crosshead at the beginning of radial compression of the tubular billet.

The arrangement of the spindles and stops outside the die space improves the safety of labor and facilitates access to the parts of the die set.

It is good practice if each stop is installed with a provision for longitudinal displacement relative to its spindle so that their total length varies.

This will speed up the refitting of the press when shifting over to pressing the tubular billets of different dimensions and promote more rational utilization of useful press time.

It is possible to fasten a detachable pulling spindle on the upper face of the rod of the pulling device, said spindle interacting with the punch.

This will facilitate machining of the tubular billets in case of different diameters of the holes in their side walls and of the tubular billets proper.

It is preferable that an intermediate spindle should be secured between the rod of the pulling device and the pulling spindle, that the ends of said intermediate spindle should be provided with T-shaped projections and the ends of the rod of the pulling device and of the pulling spindle should be provided with T-shaped slots for interaction with said projections.

This connection of the rod of the pulling device with the intermediate spindle will allow the sliding table with the lower die to be moved both in the upper and lower positions of the rod of the pulling device and, consequently, will allow the punch to be secured on the pulling spindle beyond the limits of the press.

Now the invention will be described in detail by way of example with reference to the accompanying drawings, in which.

Figure 1:
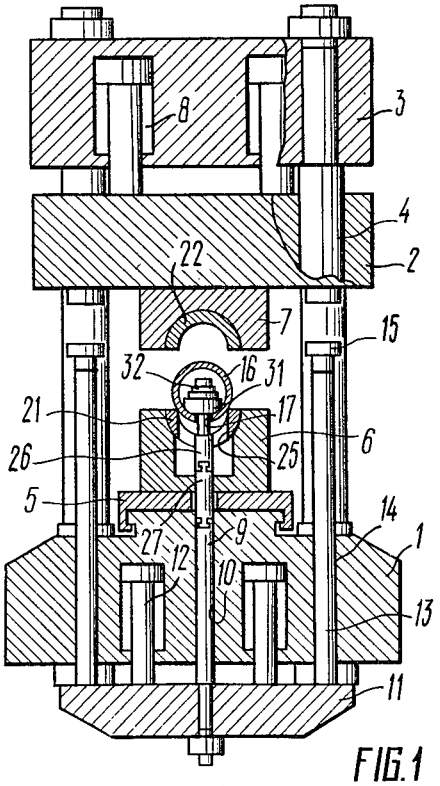
FIG. 1 is a cross section on a vertical plane along the axis of a press with two stationary crossheads in the initial position, with a partial cutout.
Figure 2:
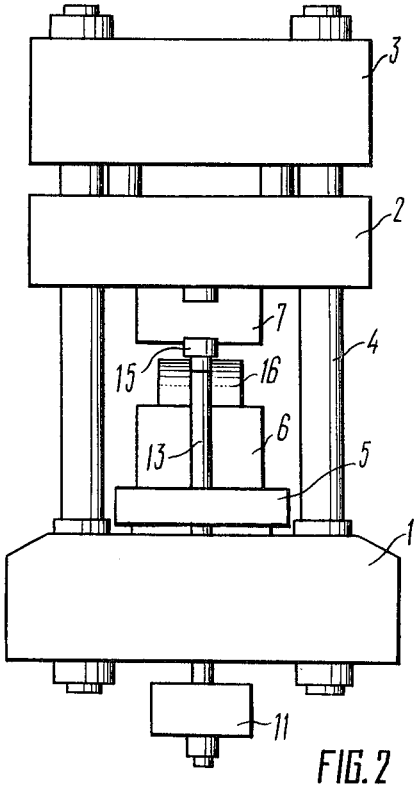
FIG. 2 is a side view of the same press.
Figure 3:
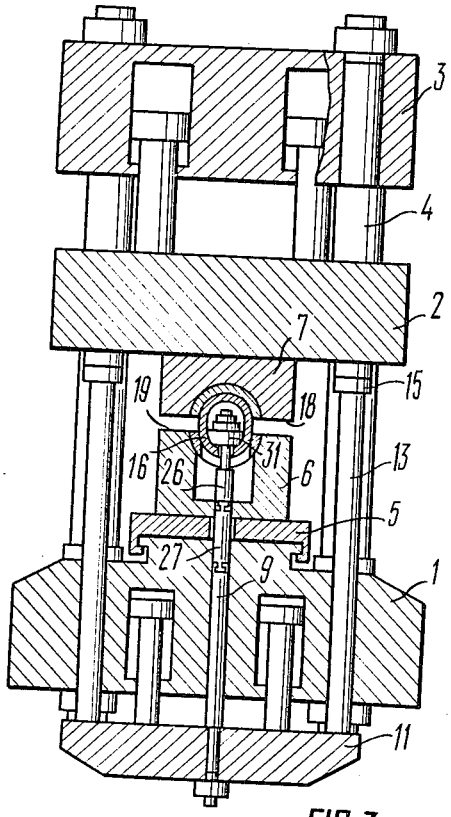
FIG. 3 is a cross section of the same press with the crossheads occupying a position at the beginning of radial compression of the tubular billet and preliminary drawing of the pipe branch.
Figure 4:
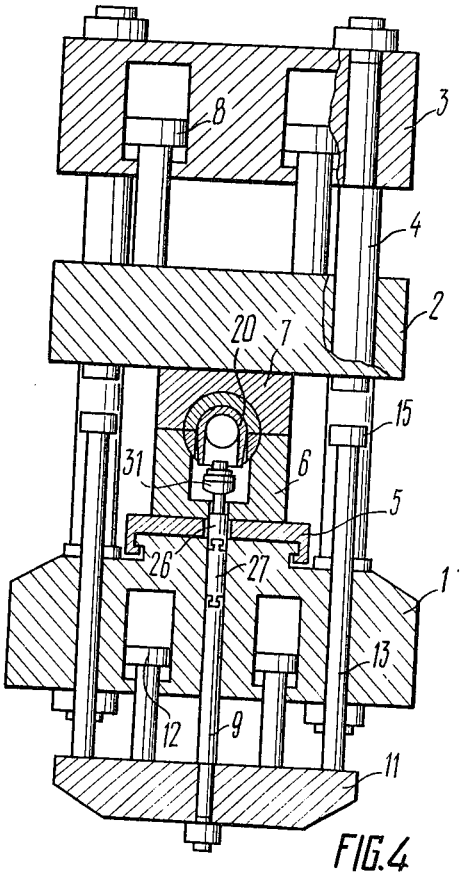
FIG. 4 is a cross section of the same press with the crossheads at the end of pressing.

The press for pressing pipe fittings (first version) comprises crossheads 1, 2 and 3 (FIGS. 1, 2, 3 and 4) arranged one above another and interconnected by pillars 4. The stationary crosshead 1 carries a sliding table 5 with the lower die 6, the upper die 7 being secured on the movable crosshead 2 above, said crosshead being provided with a reciprocating drive 8 (hydraulic cylinders) mounted on the upper stationary crosshead 3.

The stationary crosshead 1 carries a pulling device in the form of a rod 9 passing through a vertical passage 10 which extends along the press axis in the stationary crosshead 1, the sliding table 5 and the lower die 6. Located under the stationary crosshead 1 is an auxiliary crosshead 11 connected with the rod 9 and the drive 12 (hydraulic cylinders) of the pulling device. Located on the auxiliary crosshead 11 at the side of the rod 9 of the pulling device are vertical spindles 13 entering the vertical through passages 14 made in the stationary crosshead 1 which mounts the table 5 with the lower die 6. The ends of the spindles 13 are provided with stops 15; at the beginning of radial compression of the tubular billet 16 whose side wall is provided with a hole 17 said stops interact with the movable crosshead 2 which carries the upper die 7.

Each stop 15 is capable of moving longitudinally relative to the spindle 13. This changes the total length of each spindle 13 with its stop 15 which is required during processing of tubular billets 16 with different diameters and wall thicknesses.

The upper and lower dies 7 and 6 (FIG. 5) contact each other over surfaces 18 and 19 at the end of the downstroke of the movable crosshead 2. For pressing Tee-pipe 20 with different diameters of the main pipe and its brahch, the dies 6 and 7 are provided with replaceable inserts 21 and 22 having working surfaces 23 and 24. A port 25 in the lower die 6 and replaceable insert 21 serves for pressing the branch of the Tee-pipe 20.

For making branches of different diameters in the tubular billets 16, the press is provied with a pulling spindle 26 which can be secured coaxially on the upper end of the rod 9 or on the intermediate spindle 27 which is installed between the rod 9 of the pulling device and the pulling spindle 26.

The ends of the intermediate spindle 27 are provided with projections 28 Tee-shaped in cross section. These projections 28 match with Tee-shaped slots, one of the slots (29) is made on the upper end of the rod 9 of the pulling device and the other one (30), on the lower end of the pulling spindle 26.

Such a connection between the pulling spindle 26 and the intermediate spindle 27 and between said spindle 27 and the rod 9 allows the sliding table 5 to be moved both in the upper and lower positions of the rod 9 of the pulling device.

The punch 31 inserted into the space of the tubular billet 16 is locked by a shackle 32 on the pulling spindle 26.

The press according to the first version operates as follows.

Figure 5:
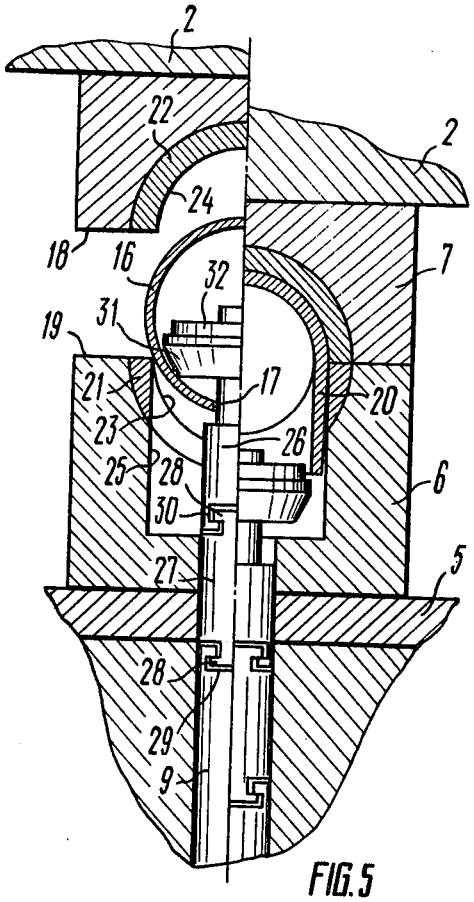
FIG. 5 shows the die with the billet, punch and shackle and the intermediate spindle connected with the pulling spindle and the rod of the pulling device. Left: initial position of die with billet Right: end of pressing.

In the initial position the movable crosshead 2 carrying the upper die 7 occupies the uppermost position as shown in FIG. 1 and in FIG. 5, left. The table 5 with the lower die 6, intermediate spindle 27 and pulling spindle 26 are moved out of the press. The rod 9 (FIG. 1) of the pulling device and the spindles 13 with stops 15 are in the uppermost position.

The tubular billet 16 whose diameter is larger than that of the finished product is heated to the pressing temperature and placed on the lower die, directing down the hole 17 in its side wall so that this hole receives the end of the pulling spindle 26 connected with the intermediate spindle 27. Then the punch 31 is inserted into the space of the tubular billet 16, put on the end of the pulling spindle 26 and locked with the shackle 32.

The table 5 with the lower die 6 and the tubular billet 16 is moved to the working position. During this movement the lower Tee-shaped projection 28 (FIG. 5) of the intermediate spindle 27 enters the Tee-shaped slot 29 on the end of rod 9 of the pulling device and connects these parts reliably.

For lowering the movable crosshead 2 (FIG. 1) and bringing the upper die 7 towards the lower die 6, the working space of the hydraulic cylinders of the drive 8 of the movable crosshead 2 are filled with fluid. As the movable crosshead 2 goes down, the upper die 7 comes in contact with the tubular billet 16 (FIG. 3) whose round cross section is first transformed into an oval section with the larger axis of the oval arranged vertically. Meanwhile the tubular billet 16 acted upon by the upper die 7 also goes down somewhat and comes in contact with the working surfaces 24 and 23 (FIG. 5) of the upper and lower dies 7 and 6. Simultaneously, the movable crosshead 2 comes in contact with the stops 15 (FIG. 3) of the spindles 13 of the pulling device so that the process of transforming the circular cross section of the tubular billet 16 into an oval section is accompanied by the downward movement of the auxiliary crosshead 11, rod 9 and the associated intermediate spindle 27, pulling spindle 26 and punch 31 locked on its end; the downward movement of the punch 31 connected with the parts of the pulling device is equal to the above-mentioned downward movement of the tubular billet 16.

At the end of the transformation of the cross section of the billet 16 into an oval section there arises a clearance between the bearing surfaces 19 and 18 of the lower and upper dies 6 and 7, said clearance depending on the relation of diameters of the billet 16 and finished product. From this moment on, as the movable crosshead 2 with the upper die 7 go further down, the tubular billet 16 begins to be radially compressed. Simultaneously, the pulling device 2 with the punch 31 continue to go down under the force of the movable crosshead 2, i.e., the radial compression of the billet 16 is accompanied by insertion of the punch 31 into the wall of the billet in which case the metal of the billet 16 is squeezed out through the port 25 (FIG. 5) in the lower die thus forming preliminarily (drawing) the branch of the Tee-pipe. The process of radial compression of the tubular billet 16 and preliminary drawing of the branch of the Tee-pipe 20 is finished at the moment of complete closing of the surfaces 18 and 19 of the upper and lower dies 7 and 6. Zhe punch 31 stays in the space of the tubular billet 16.

For final forming of the branch of the Tee-pipe 20 and complete withdrawal of the punch 31 from the space of the tubular billet 16, the fluid is fed into the hydraulic cylinders of the drive 12 (FIG. 4) of the pulling device so that the auxiliary crosshead 11 and the associated spindles 13 with stops 15 as well as the rod 9 with the pulling spindle 26 and punch 31 go further down until the punch 31 withdraws completely from the formed branch of the Tee-pipe 20.

This completes the process of pressing the Tee-pipe 20. The movable crosshead 2 of the press and the pulling device rise to the uppermost position, the table 5 with the lower die 6 and the pressed article 20 slide out of the press and the finished Tee-pipe 20 is removed from the lower die 6. The shackle 32 and the punch 31 are removed from the pulling spindle 26 (FIG. 5) and the press is ready for pressing the next article.

The provision of the intermediate spindle 27 with the Tee-shaped projections 28 on its ends, connecting the pulling spindle 26 with the rod 9 of the pulling device ensures engagement and disengagement of the pulling spindle 26 and rod 9 in the upper and lower positions during the motions of the table 5 with the lower die 6 in the course of pressing and setting-up operations. In order to change over for passing Tee-pipes 20 with different pipe diameters and wall thicknesses it is necessary to replace the inserts 21 and 22 of the lower and upper dies 6 and 7, the punch 31, the shackle 32 and the pulling spindle 26.

Besides, the position of the stops 15 (FIG. 1) on the spindles 13 of the pulling device is adjusted so that radial compression of the tubular billet 16 would begin simultaneously with the drawing of the branch of the Tee-pipe 20.

Figure 6:
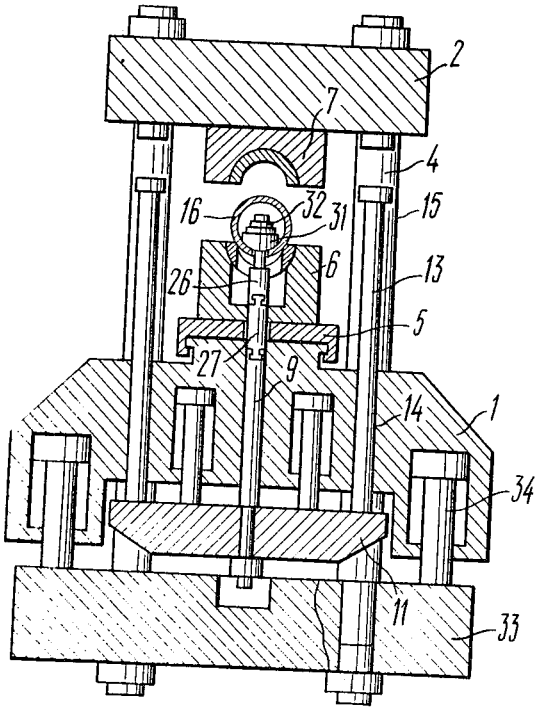
FIG. 6 is a cross section of the press with a stationary crosshead and two movable crossheads and with spindles and stops located on the top of the auxiliary crosshead.

In another version of the invention the press comprises two movable crossheads 2 and 33 (FIG. 6) interconnected by pillars 4. The crosshead 33 is arranged below the auxiliary crosshead 11. In this case the crossheads 2 and 33 with the pillars 4 are moved by a common drive 34 installed in the stationary crosshead 1.

The second version of the press functions basically as the first one, the only difference being in that the movable crosshead 2 with the upper die 7 is lowered by the hydraulic cylinders of the drive 34 acting on the lower movable crosshead 33 located under the auxiliary crosshead 11 of the pulling device and connected by pillars 4 with the movable crosshead 2.

Figure 7:
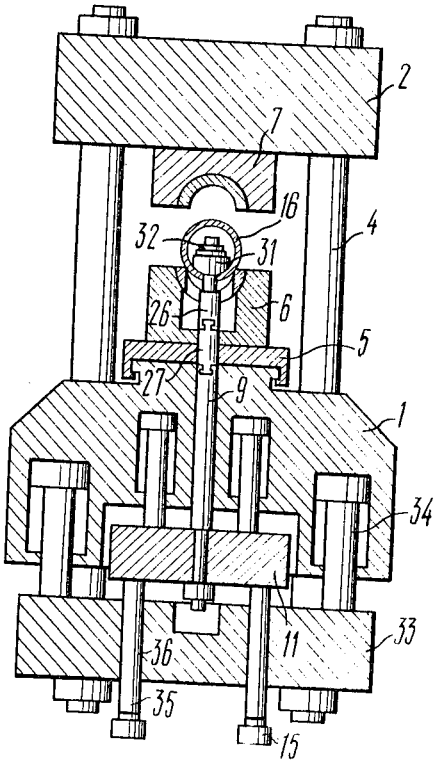
FIG. 7 is a cross section of the press shown in FIG. 4 with spindles and stops located on the underside of the auxiliary crosshead.

In the third version the press has two movable crossheads 2 and 33 (FIG. 7) and one stationary crosshead 1. The vertical spindles 35 on the auxiliary crosshead 11 are located at the side of the lower movable crosshead 33 which has vertical through passages 36 accommodating said spindles 35. The free ends of said spindles 35 are provided with stops 15 interacting with the movable crosshead 33 when it goes down at the beginning of radial compression of the tubular billet 16.

The press according to the third version functions basically as in the first two versions, the sole difference being in that during preliminary drawing of the branch of the Tee-pipe performed simultaneously with radial compression of the tubular billet 16, the stops 15 secured on the spindles 35 of the pulling device interact with the lower movable crosshead 33.

Apart from Tee-pipes and cross pipes the press can be used for pressing tubular billets 16 into products with a curvilinear longitudinal axis and side branches, tapered reducers with calibrated cylindrical portion of a smaller diameter.

We claim:

1. A press for pressing pipe fittings from tubular billets comprising: a stationary crosshead; a sliding table mounted on said stationary crosshead; a lower die mounted on said sliding table, a vertical passage along the press axis and extending through said stationary crosshead, said sliding table and said lower die; a movable crosshead located above said stationary crosshead and carrying an upper die; a third crosshead, connecting means for interconnecting said stationary crosshead, said movable crosshead, and said third crosshead comprising pillars; a drive means associated with said third crosshead for reciprocating said movable crosshead whereby said upper die is moved into engagement with said lower die; a pulling device means for pulling a punch along the press axis and through a tubular billet comprising a rod carried within said vertical axial passage of said stationary crosshead, an auxiliary crosshead positioned below said stationary crosshead, means for connecting said rod to said auxiliary crosshead, pulling device drive means associated with said stationary crosshead and connected to said auxiliary crosshead for driving said auxiliary crosshead with respect to said stationary crosshead thus moving said rod within said vertical axial passage, said auxiliary crosshead further comprising a pair of vertical spindles with stops mounted at the ends of the vertical spindles for contacting said movable crosshead at the beginning of radial compression of the tubular billet by said upper and lower die, wherein said rod is axially movable a first predetermined distance by means of said movable crosshead contacting said stops mounted at the ends of said vertical spindles and moving said vertical spindles until said upper die carried on said movable crosshead contacts said lower die mounted on said sliding table, and axially movable a second predetermined distance by said pulling device drive means.

2. A press according to claim 1 wherein said vertical spindles of the auxiliary crosshead are located at either side of said rod of said pulling device means and wherein said stationary crosshead carrying said sliding table further comprises a pair of vertical through passages for said vertical spindles.

3. A press according to claim 2 wherein each said stop comprises means for longitudinally moving said stop relative to its spindle for changing the total length of said spindle and said stop.

4. A press according to claim 1 wherein the upper end of said rod of the pulling device means carries a detachable pulling spindle secured coaxially to said rod and said punch is mounted to said detachable pulling spindle.

5. A press according to claim 4 further comprising an intermediate spindle secured between said rod of the pulling device means and said pulling spindle, the ends of said intermediate spindle being provided with T-shaped projections and the ends of said rod of the pulling device means and said pulling spindle have T-shaped slots for slidable connection with said T-shaped projections of said intermediate spindle.

6. A press for pressing pipe fittings from tubular billets comprising: a stationary crosshead; a sliding table mounted on said stationary crosshead; a lower die mounted on said sliding table; a vertical passage along the press axis and extending through said stationary crosshead, said sliding table, and said lower die; a movable crosshead located above said stationary crosshead and carrying an upper die; a third crosshead; connecting means for interconnecting said stationary crosshead, movable crosshead, and third crosshead, comprising pillars; a drive means for reciprocating said movable crosshead whereby said upper die is moved into engagement with said lower die; a pulling device means for pulling a punch along the press axis and through a tubular billet comprising a rod carried within said vertical axial passage of said stationary crosshead, an auxiliary crosshead positioned below said stationary crosshead, means for connecting said rod to said auxiliary crosshead, pulling device drive means associated with said stationary crosshead and connected to said auxiliary crosshead for driving said auxiliary crosshead with respect to said stationary crosshead, thus moving said rod within said vertical axial passage, said auxiliary crosshead further comprising a pair of vertical spindles with stops mounted at the ends of the vertical spindles for contacting said third crosshead, wherein said third crosshead is located below said auxiliary crosshead, and wherein said drive means is associated with said stationary crosshead, and is connected to said third crosshead for moving said third crosshead and said movable crosshead, whereby the upper die is moved into engagement with said lower die, said third crosshead having vertical through passages accommodating the vertical spindles and wherein said stops of the vertical spindles contact the third crosshead at the beginning of radial compression of the tubular billet by said upper and lower dies, wherein said rod is axially movable a first predetermined distance by means of said third crosshead contacting said stops mounted at the ends of said vertical spindles and moving said vertical spindles until said upper die carried on said movable crosshead contacts said lower die mounted on said sliding table, and axially movable a second predetermined distance by said pulling device drive means.

7. A press according to claim 6 wherein each said stop comprises means for longitudinally moving said stop relative to its spindle for changing the total length of said spindle and said stop.

* * * * *